US005719590A

United States Patent [19]

Shimada et al.

[11] Patent Number: 5,719,590

[45] Date of Patent: Feb. 17, 1998

[54] METHOD FOR DRIVING AN ACTIVE MATRIX SUBSTRATE

[75] Inventors: Shinji Shimada, Kashihara; Naoko Kawazu, Kitakatsuragi-gun, both of Japan

[73] Assignee: Sharp Kabushiki Kaisha, Osaka, Japan

[21] Appl. No.: 617,354

[22] Filed: Mar. 18, 1996

Related U.S. Application Data

[63] Continuation of Ser. No. 317,865, Oct. 4, 1994, abandoned.

[30] Foreign Application Priority Data

Oct. 6, 1993 [JP] Japan ..... 5-250830

[51] Int. Cl.[6] ..... G09G 3/36

[52] U.S. Cl. ..... 345/94; 345/99

[58] Field of Search ..... 345/58, 87, 89, 345/94–97, 101, 103, 208–210

[56] References Cited

U.S. PATENT DOCUMENTS

| | | | |
|---|---|---|---|
| 4,870,398 | 9/1989 | Bos | 345/97 |
| 4,901,066 | 2/1990 | Kobayashi et al. | 345/97 |
| 5,111,317 | 5/1992 | Coulson | 345/97 |
| 5,136,282 | 8/1992 | Inaba et al. | 34/97 |
| 5,136,408 | 8/1992 | Okada et al. | 345/97 |
| 5,182,549 | 1/1993 | Taniguchi et al. | 345/97 |

FOREIGN PATENT DOCUMENTS 2-2512 1/1990 Japan .

*Primary Examiner*—Steven Saras

*Attorney, Agent, or Firm*—Nixon & Vanderhye P.C.

[57] ABSTRACT

A method for driving an active matrix substrate including a plurality of scanning electrode lines, a plurality of data electrode lines, and a plurality of pixel electrodes respectively connected to the scanning electrode lines and the data electrode lines via a ferroelectric material. According to the method, a data writing pulse having a first polarity is applied to a scanning electrode line selected from the plurality of scanning electrode lines in a selection period. A data writing prohibiting pulse having a level of 0 is applied to the selected scanning electrode line in a first period included in a non-selection period following the selection period. In the first period, a data writing pulse having the first polarity is applied to a scanning electrode line different from the selected scanning electrode line. A data writing prohibiting pulse having the first polarity is applied to the selected scanning electrode line in a second period included in the non-selection period. In the second period, a data writing pulse having a second polarity is applied to a scanning electrode line different from the selected scanning electrode line. A data pulse having the second polarity or a level of 0 is applied to the respective plurality of data electrode lines in the first period. A data pulse having the first polarity or a level of 0 is applied to the respective plurality of data electrode lines in the second period.

8 Claims, 9 Drawing Sheets

(a) X1
(b) X2
(c) X3
(d) X4
(e) X5
Time
(l) (1,1) off
(m) (1,6) on
(n) (2,3) on
(o) (3,3) off
Y1
Y2
Y3
Y4
Y5
Y6
(f)
(g)
(h)
(i)
(j)
(k)
Time
W
R

METHOD FOR DRIVING AN ACTIVE MATRIX SUBSTRATE

This is a continuation of application Ser. No. 08/317,865, filed Oct. 4, 1994, now abandoned.

BACKGROUND OF THE INVENTION

1. Field of the Invention

The present invention relates to a method for driving an active matrix substrate for use in, for example, a liquid crystal display (hereinafter, referred to as an "LCD") device, and in particular to a method for driving such an active matrix substrate including a nonlinear device formed of a ferroelectric material.

2. Description of the Related Art

Active matrix substrates for use in, for example, an LCD device include a nonlinear device formed of a ferroelectric material. A general ferroelectric material presents a hysteresis loop as is shown in FIG. 8 illustrating the relationship between the electric displacement (D) and the electric field strength (E). The ferroelectric material obtains a potential having a polarity in accordance with the polarity of the electric field applied thereto, and stores the charge of such a polarity even after being turned OFF. Accordingly, in an active matrix substrate having a nonlinear device formed of a ferroelectric material connected to, for example, a liquid crystal material, a voltage in proportion to the charge applied to the ferroelectric material can be applied to the liquid crystal material. Further, even if the nonlinear device is turned OFF, the charge is stored in the liquid crystal material, which presents an excellent memory function.

In order to drive an active matrix substrate, a line-by-line driving method as described in Japanese Laid-Open Patent Publication No. 2-2512 is generally used. In this method, all the electrode lines on the active matrix substrate are first reset, and then data are sequentially written line by line. Briefly referring to FIG. 9, such a method will be described in detail. FIG. 9 is a waveform diagram illustrating, in a simplified manner, signal waveforms obtained at various elements of the active matrix substrate by the method.

Before data are written in each of a plurality of frames, reset pulses R each having an opposite polarity to the polarity of a data writing pulse W are respectively applied simultaneously to all the scanning electrode lines, for example, to scanning electrode lines $X_{n-1}$, $X_n$ and $X_{n+1}$ as is shown in waveforms 9(*a*), 9(*b*) and 9(*c*). At this point, a writing compensation pulse G is applied to data electrode lines $Y_{m(b)}$ and $Y_{m(w)}$ as is shown in waveforms 9(*d*) and 9(*e*). FIG. 9, the data writing pulses W all have a level of +V, and the reset pulses R all have a level of −V.

Then, as is shown in waveforms 9(*a*), 9(*b*) and 9(*c*), the data writing pulses W are respectively applied to the scanning electrode lines $X_{n-1}$, $X_n$ and $X_{n+1}$ to turn "ON" the corresponding nonlinear devices sequentially. At this point, the data electrode $Y_{m(b)}$ is supplied, for example, with a data signal Dn having a level of −V for displaying black, and the data electrode $Y_{m(w)}$ is supplied, for example, with a data signal Dn having a level of 0 V for displaying white. As a result, as is shown in waveform 9(*f*), a nonlinear device $X_nY_{m(b)}$ which has been turned "ON" for displaying black is supplied with a potential of +2 V which corresponds to a level obtained by subtracting the level of the data signal Dn (−V) from the level of the data writing pulse W (+V). As is shown in waveform 9(*g*), a nonlinear device $X_nY_{m(w)}$ which has been turned "ON" for displaying white is supplied with a potential of +V which corresponds to a level obtained by subtracting the level of the data signal Dn (0 V) from the level of the data writing pulse W (+V). In this manner, data writing is performed.

In the case where such a conventional method is used for driving a display device including, for example, a liquid crystal material, the following problems occur. When all the electrode lines are reset, an image plane displays nothing momentarily before line-by-line data writing starts. Accordingly, an image area corresponding to the first row of pixels to receive the data and an image corresponding to the last row of pixels to receive the data are displayed for significantly different lengths of time from each other. Such a difference causes non-uniformity in the image contrast, and thus deteriorates the display quality in a still image as well as in an active image. As a result, the field of practical use of such an active matrix substrate is significantly restricted.

Returning to FIG. 8, when data is written using an electric field having a sufficient strength of the positive polarity, the ferroelectric material obtains a potential of point A on the hysteresis loop. If the polarity of the electric field after data writing is identical with the polarity of the electric field used for data writing, the potential of the ferroelectric material is reduced to a point between points A and B. Since the difference between points A and B is small, the potential reduction is relatively small. By contrast, if the polarity of the electric field after data writing is opposite to the polarity of the electric field used for data writing, the potential is reduced to a point between points B and C. Since the difference between points B and C is much larger than the difference between points A and B, the potential is reduced drastically. As a consequence, the memory function, which is a feature of the nonlinear device formed of a ferroelectric material is lost. When the potential is reduced to a point below point C in the same frame, polarity inversion in the potential occurs and thus the quality of a display device including the active matrix substrate is seriously lowered.

SUMMARY OF THE INVENTION

A method according to the present invention for driving an active matrix substrate including a plurality of scanning electrode lines, a plurality of data electrode lines, and a plurality of pixel electrodes respectively connected to the scanning electrode lines and the data electrode lines via a ferroelectric material includes the steps of applying a data writing pulse having a first polarity to a scanning electrode line selected from the plurality of scanning electrode lines in a selection period; applying a data writing prohibiting pulse having a level of 0 to the selected scanning electrode line in a first period included in a non-selection period following the selection period, a data writing pulse having the first polarity being applied to a scanning electrode line different from the selected scanning electrode line during the first period; applying a data writing prohibiting pulse having the first polarity to the selected scanning line in a second period included in the non-selection period, a data writing pulse having a second polarity being applied to a scanning electrode line different from the selected scanning electrode line during the second period; applying a data pulse having one of the second polarity and a level of 0 to the respective plurality of data electrode lines in the first period; and applying a data pulse having one of the first polarity and a level of 0 to the respective plurality of data electrode lines in the second period.

According to the present invention, a signal applied to a certain pixel electrode during a non-selection period of a scanning electrode line connected to the pixel electrode has the same polarity as that of a data writing pulse W applied to the pixel electrode during a selection period thereof immediately preceding the non-selection period (referring to FIG. 8, corresponding to a point between points A and B) or has a level of 0 V. Thus, the reduction in the potential is small, as a result of which, the memory function of the ferroelectric material can be maintained sufficiently well.

The polarity of the scanning signal applied to the scanning electrode lines is inverted line by line or block by block each including a plurality of scanning electrode lines. Accordingly, in a display device such as an LCD device, the non-uniformity in the image contrast which is caused by the phenomenon that different pixel electrodes receive different voltages during the non-selection period because of different pulses applied thereto during the selection period can be substantially solved.

In the case where the number of scanning electrode lines included in each block is not a divisor of the total number of scanning electrode lines, the first one or more scanning electrode lines in a certain frame in a number which is equal to the remainder in the previous frame is supplied with a signal having an identical polarity with or an opposite polarity to that of the scanning electrode lines included in the remainder in the previous frame. In this manner, in a display device such as an LCD device, the uniformity in the image contrast is further improved.

The electrode lines are reset immediately before data writing. Consequently, the time period required from reset until data writing can be substantially the same over the entire display plane. As a result, in a display device such as an LCD device, an image area corresponding to the first row of pixels to receive the data and an image area corresponding to the last row of pixels are displayed for substantially the same length of time. This also improves the uniformity in the image contrast.

Thus, the invention described herein makes possible the advantage of providing a method for driving an active matrix substrate for maintaining the memory function of a nonlinear device formed of a ferroelectric material.

This and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

Figure 1:
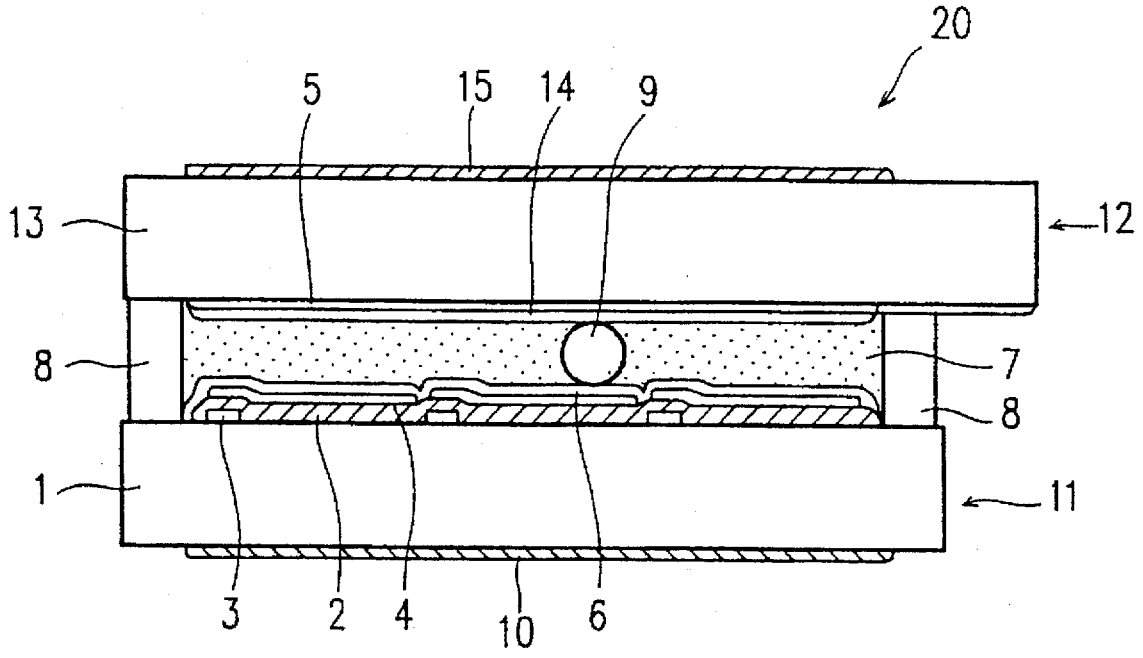
FIG. 1 is a schematic cross sectional view of an LCD device including an active matrix substrate which can be driven by a method according to the present invention.

Referring to FIG. 1, an LCD device 20 to which the present invention is applicable will be described. In the LCD device 20, a twisted nematic (TN) liquid crystal material is used. FIG. 1 is a cross sectional view of the LCD device 20. As is shown in FIG. 1, the LCD device 20 includes an active matrix substrate 11 and a counter substrate 12 located opposed to each other, interposing a liquid crystal layer 7 therebetween. The active matrix substrate 11 includes a base plate 1. On a surface of the base plate 1 which is closer to the liquid crystal layer 7 than the other surface, a plurality of linear data electrode lanes 3 are arranged in parallel, and a ferroelectric layer 2 is provided on substantially the entire surface of the base plate 1 covering the data electrode lines 3. A part of the ferroelectric layer 2 acts as a nonlinear device. On the ferroelectric layer 2, a plurality of scanning electrode lines (not shown) are arranged in parallel on the ferroelectric layer 2, in a direction crossing the data electrode lines 3. Further, a plurality of pixel electrodes 4 and an alignment layer 6 are provided in this order. A polarizing plate 10 is located on the other side of the base plate 1.

The counter substrate 12 includes a base plate 13. On a surface of the base plate 13 which is closer to the liquid crystal layer 7 than the other surface, a transparent counter electrode 5 and an alignment layer 14 are provided in this order. A polarizing plate 15 is located on the other side of the base plate 13.

The base plates i and 13 are formed of, for example, glass or a polymer. The data electrode lines 3 are formed of a conductive material such as aluminum, tantalum, titanium, molybdenum, copper, or indium-tin-oxide (hereinafter, referred to as "ITO"). The pixel electrodes 4 are formed of, for example, ITO. The ferroelectric layer 2 is formed of, for example, a ferroelectric polymer such as poly(vinylidene fluoride), a copolymer of poly(vinylidene fluoride) and trifluoroethylene, a copolymer of poly(vinylidene fluoride) and tetrafluoroethylene, or a copolymer of poly(vinylidene cyanide) and vinyl acetate, or an inorganic ferroelectric material such as barium titanate, lead titanate jirconate or lanthanum lead titanate jirconate, or a compound of a ferroelectric liquid crystal material and a polymer.

The LCD device 20 is produced in the following manner.

First, on the base plate 1, the data electrode lines 3, the ferroelectric layer 2, the scanning electrode lines (not shown), the pixel electrodes 4, and the alignment layer 6 are formed in a known manner. Next, the resultant laminate is baked to form the active matrix substrate 11. On the base plate 13, the counter electrode 5 and the alignment layer 14 are formed in a known manner, and the resultant laminate is baked to form the counter substrate 12.

The alignment layers 6 and 14 are treated for alignment in a prescribed direction, and spacers 9 are scattered on either the active matrix substrate 11 or the counter substrate 12. Then, the two substrates 11 and 12 are assembled together so as to have the alignment layers 6 and 14 inside. The opposed peripheries of the substrates 11 and 12 are adhered together with a sealing material except for an injection opening, and a liquid crystal material is injected into the assembly to form the liquid crystal layer 7. Next, the injection opening is sealed. The polarizing plates 10 and 15 are formed on the outer surfaces of the substrates 11 and 12, respectively, in a prescribed relative direction, and then a driving circuit (not shown) is mounted. Thus, the LCD device 20 is produced.

EXAMPLE 1

Figure 2:
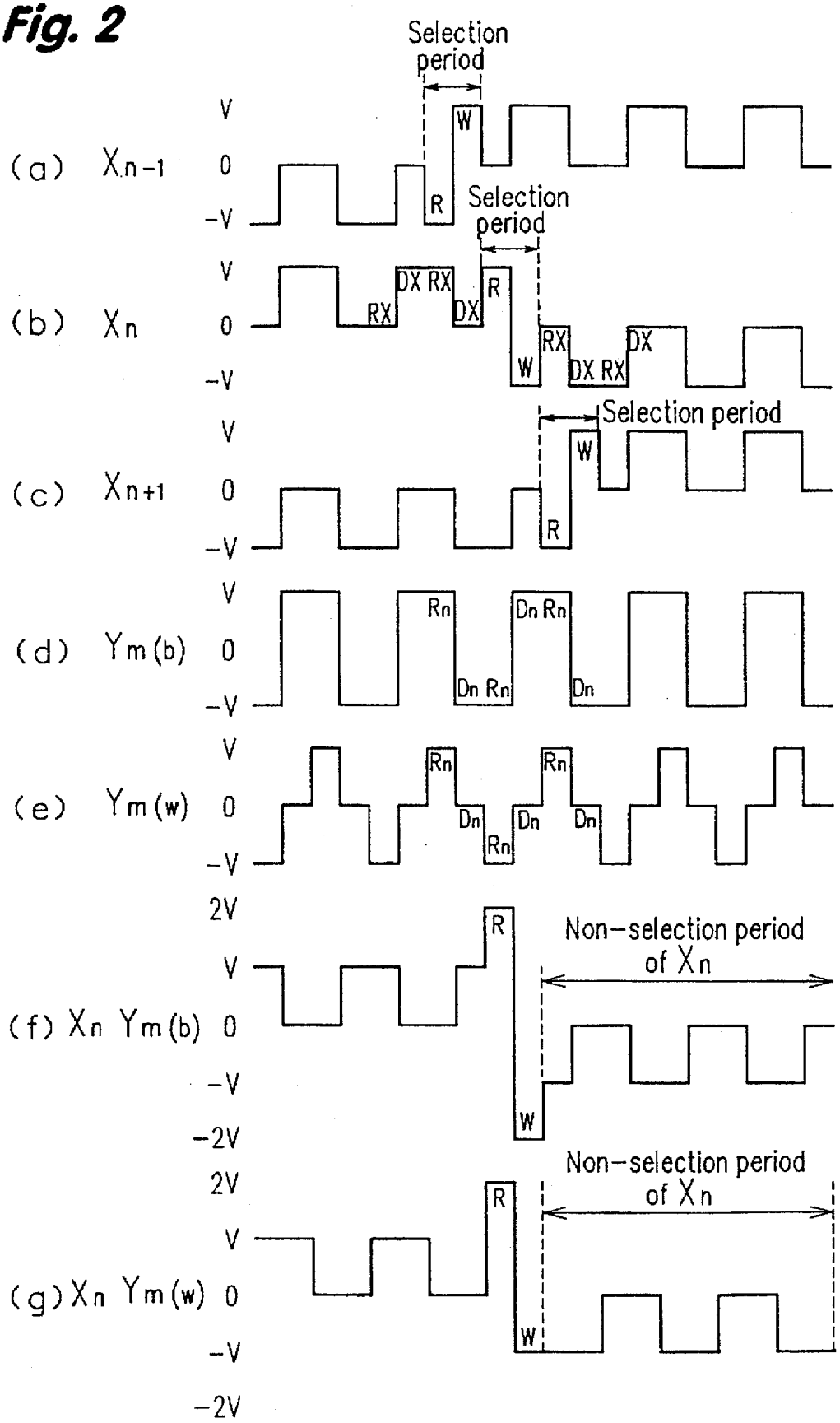
FIG. 2 is a waveform diagram illustrating signal waveforms at various elements of the active matrix substrate obtained by a driving method in a first example according to the present invention.

With reference to FIG. 2, a method for driving an active matrix substrate in a first example according to the present invention will be described. The active matrix substrate has the above-described structure.

FIG. 2 shows signal waveforms obtained at various elements of the active matrix substrate by the driving method in accordance with the first example. Waveforms 2(*a*) through 2(*c*) respectively indicate scanning signals applied to scanning electrode lines $X_{n-1}$, $X_n$, and $X_{n+1}$ by a scanning driver. The scanning electrode lines $X_{n-1}$, $X_n$, and $X_{n+1}$ are adjacent to each other. Waveform 2(*d*) indicates a data signal applied to a data electrode line $Y_m$ by a data driver in order to turn ON the corresponding pixel, and waveform 2(*e*) indicates a data signal applied to the data electrode line $Y_m$ by the data driver in order to turn OFF the corresponding pixel. Waveform 2(*f*) indicates a voltage applied to the pixel connected to the scanning electrode lines $X_n$ and the data electrode line $Y_m$ when the pixel is ON. Waveform 2(*g*) indicates a voltage applied to the pixel connected to the scanning electrode lines $X_n$ and the data electrode line $Y_m$ when the pixel is OFF. The voltage applied to the pixel is equal to the difference between the voltage applied to the corresponding scanning electrode line $X_n$ and the corresponding data electrode line $Y_m$.

According to the present invention, basically line-by-line driving is performed, in which a plurality of scanning electrode lines are sequentially selected one by one. Each scanning electrode line which has been selected is supplied with a reset pulse R and a data writing pulse W. The period through which each scanning electrode line is selected is referred to as a "selection period". During the selection period, a data signal corresponding to an ON state or an OFF state of the pixel is applied to each of a plurality of data electrode lines. In the example illustrated in FIG. 2, each time a scanning electrode is selected, the polarity of the data signal is inverted. The polarity of the scanning signal is also inverted in accordance therewith.

With reference to FIG. 2, a method for driving the active matrix substrate in the first example will be described in detail.

In this example, the polarity of the data writing pulse W applied to the scanning electrode line $X_n$ in the selection period of the scanning electrode line $X_n$ is set to be negative. In such a case, as is shown in waveform 2(*b*), a reset pulse having a level of +V and a data writing pulse W having a level of −V are applied to the scanning electrode line $X_n$ in the selection period thereof.

The polarity of the pulse applied to the scanning electrode line $X_{n-2}$ (not shown) in the selection period of the scanning electrode line $X_{n-2}$ is identical with the polarity of the same type of pulse applied to the scanning electrode line $X_n$ in the selection period of the scanning electrode line $X_n$. The scanning electrode line $X_{n-2}$ is a scanning electrode line preceding the scanning electrode line $X_n$ by an even number. In the selection period of the scanning electrode line $X_{n-2}$, a reset pulse R and a data writing pulse W are applied to the scanning electrode line $X_{n-2}$. In synchronization with the application of the reset pulse R and the data writing pulse W, a reset compensation pulse RX having a level of 0 V and a data writing prohibiting pulse DX having a level of +V are applied to the scanning electrode line $X_n$ (waveform 2(*b*)).

As is appreciated from waveforms 2(*a*) and 2(*b*), the polarity of the pulse applied to the scanning electrode line $X_{n-1}$ in the selection period of the scanning electrode line $X_{n-1}$ is opposite to the polarity of the same type of pulse applied to the scanning electrode line $X_n$ in the selection period of the scanning electrode line $X_n$. The scanning electrode line $X_{n-1}$ is a scanning electrode line preceding the scanning electrode line $X_n$ by an odd number. In the selection period of the scanning electrode line $X_{n-1}$, a reset pulse R and a data writing pulse W are applied to the scanning electrode line $X_{n-1}$. In synchronization with the application of the reset pulse R and the data writing pulse W, a reset compensation pulse RX having a level of +V and a data writing prohibiting pulse DX having a level of 0 V are applied to the scanning electrode line $X_n$ (waveform 2(*b*)).

As is appreciated from waveforms 2(*b*) and 2(*c*), the polarity of the pulse applied to the scanning electrode line $X_{n+1}$ in the selection period of the scanning electrode line $X_{n+1}$ is opposite to the polarity of the same type of pulse applied to the scanning electrode line $X_n$ in the selection period of the scanning electrode line $X_n$. The scanning electrode line $X_{n+1}$ is a scanning electrode line following the scanning electrode line $X_n$ by an odd number. In the selection period of the scanning electrode line $X_{n+1}$, a reset pulse R and a data writing pulse W are applied to the scanning electrode line $X_{n+1}$. In synchronization with the application of the reset pulse R and the data writing pulse W, a reset compensation pulse RX having a level of 0 V and a data writing prohibiting pulse DX having a level of −V are applied to the scanning electrode line $X_n$ (waveform 2(*b*)).

The polarity of the pulse applied to the scanning electrode line $X_{n+2}$ (not shown) in the selection period of the scanning electrode line $X_{n+2}$ is identical with the polarity of the same type of pulse applied to the scanning electrode line $X_n$ in the selection period of the scanning electrode line $X_n$. The scanning electrode line $X_{n+2}$ is a scanning electrode line following the scanning electrode line $X_n$ by an even number. In the selection period of the scanning electrode line $X_{n+2}$, a reset pulse R and a data writing pulse W are applied to the scanning electrode line $X_{n+2}$. In synchronization with the application of the reset pulse R and the data writing pulse W, a reset compensation pulse RX having a level of −V and a data writing prohibiting pulse DX having a level of 0 V are applied to the scanning electrode line $X_n$ (waveform 2(*b*)).

In order to turn ON the pixel, as is illustrated in waveform 2(*d*), a data signal having levels of −V and +V repeated alternately is applied to the data electrode line $Y_m$. In more detail, in the selection period of each scanning electrode line, in synchronization with the application of the reset pulse R and a data writing pulse W to the selected scanning electrode line, a reset pulse $R_n$ having an opposite polarity to the polarity of the reset pulse R and a data pulse $D_n$ having an opposite polarity to the polarity of the data writing pulse W are applied to the data electrode line $Y_m$.

In order to turn OFF the pixel, as is illustrated in waveform 2(*e*), a data signal having levels of −V, 0 V and +V repeated alternately is applied to the data electrode line $Y_m$. In more detail, in the selection period of each scanning electrode line, in synchronization with the application of the reset pulse R and a data writing pulse W to the selected scanning electrode line, a reset pulse $R_n$ having an opposite polarity to the polarity of the reset pulse R and a data pulse $D_n$ having a level of 0 V are applied to the data electrode line $Y_m$.

The pixel electrode is supplied with a voltage having a level obtained by subtracting the level of the data signal from the level of the scanning signal. In order to turn ON the pixel connected to the scanning electrode line $X_n$ and the data electrode line $X_m$, pulses are applied as is illustrated in waveform 2(*f*). First, in the selection period of the scanning electrode line $X_n$, a data writing pulse W having a level of −2 V is applied to the pixel electrode. Next, in a non-selection period of the scanning electrode line $X_n$, pulses having levels of −V and 0 V are applied to the pixel electrode.

In order to turn OFF the pixel connected to the scanning electrode $X_n$ and the data electrode $Y_m$, pulses are applied as is illustrated in waveform 2(*g*). First, in the selection period of the scanning electrode line $X_n$, a data writing pulse W having a level of −V is applied to the pixel electrode. Then, in a non-selection period of the scanning electrode line $X_n$, pulses having levels of −V and 0 V are applied to the pixel electrode.

By applying voltages to the pixel electrode in the above-described manner, the signal applied to the pixel electrode during the non-selection period of the scanning electrode line connected to the pixel electrode can obtain the same polarity as that of the data writing pulse W applied to the pixel electrode during the selection period immediately preceding the non-selection period or obtain a level of 0 V. Specifically, the polarity of a voltage obtained by averaging voltages applied to the pixel electrode during the non-selection period is not opposite to the polarity of the data writing pulse W during the selection period just before the non-selection period.

Figure 3:
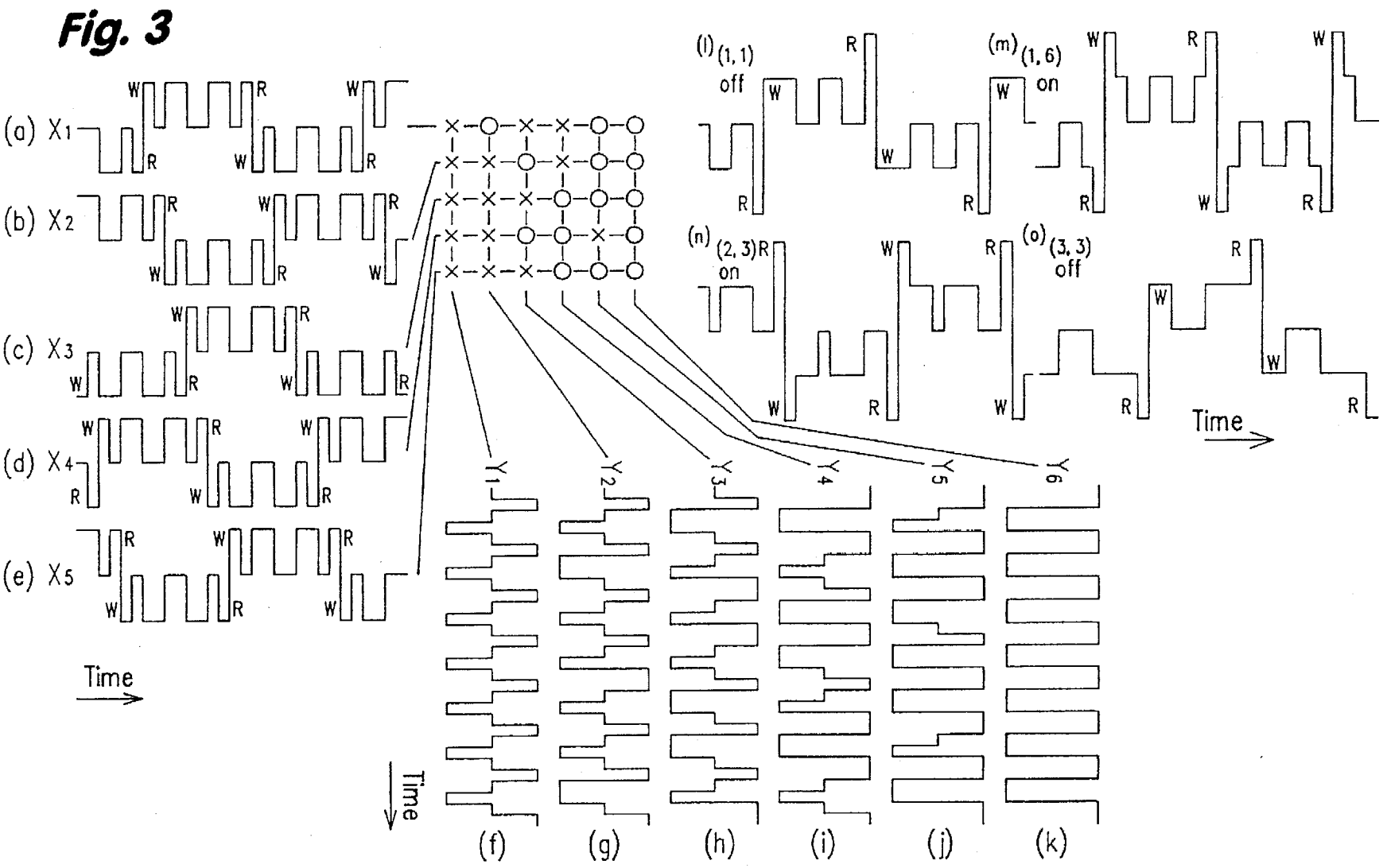
FIG. 3 is a diagram illustrating the display state of a 5×6 dot matrix LCD device driven by the method in accordance with the first example and signal waveforms obtained at various elements of an active matrix substrate used in the LCD device.

FIG. 3 is a diagram illustrating the display state of a 5×6 dot matrix LCD device driven by the method in the first example and signal waveforms obtained at various elements of an active matrix substrate in the LCD device. In FIG. 3, the symbol ○ indicates the pixel which is in the ON state, and the symbol x indicates the pixel which is in the OFF state. Waveforms 3(*a*) through 3(*e*) indicate the scanning signals applied to the scanning electrode lines $X_1$ through $X_5$, respectively. Waveforms 3(*f*) through 3(*k*) indicate the data signals applied to the data electrode lines $Y_1$ through $Y_6$. Waveform 3(*l*) indicates the signal applied to the pixel electrode at position ($X_1$, $Y_1$), waveform 3(*m*) indicates the signal applied to the pixel electrode at position ($X_1$, $Y_6$), waveform 3(*n*) indicates the signal applied to the pixel electrode at position ($X_2$, $Y_3$), and waveform 3(*o*) indicates the signal applied to the pixel electrode at position ($X_3$, $Y_3$). In the example shown in FIG. 3, the maximum level of the scanning signal has the same absolute value as that of the maximum level of the data signal.

Figure 8:
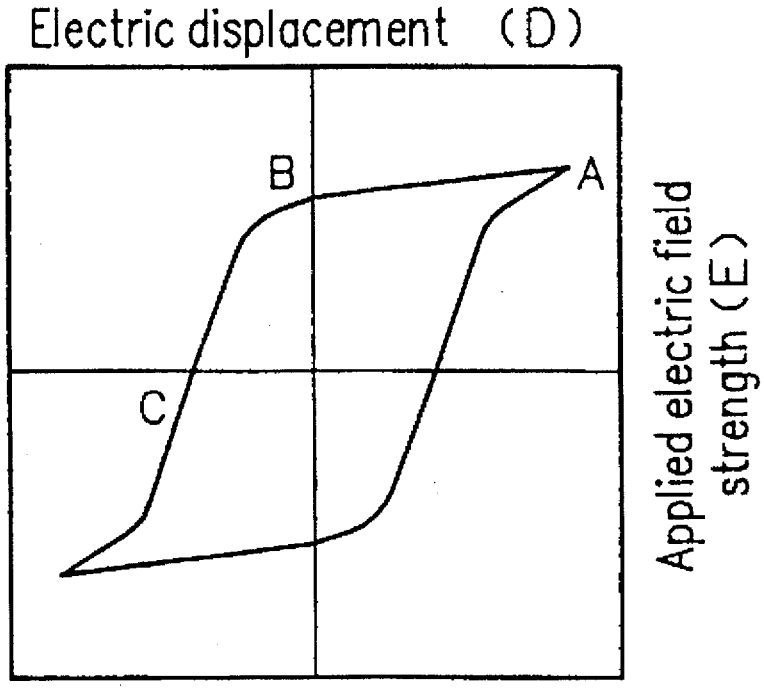
FIG. 8 is a graph illustrating a hysteresis loop presented by a general ferroelectric material used in an active matrix substrate in a display device.
Figure 9:
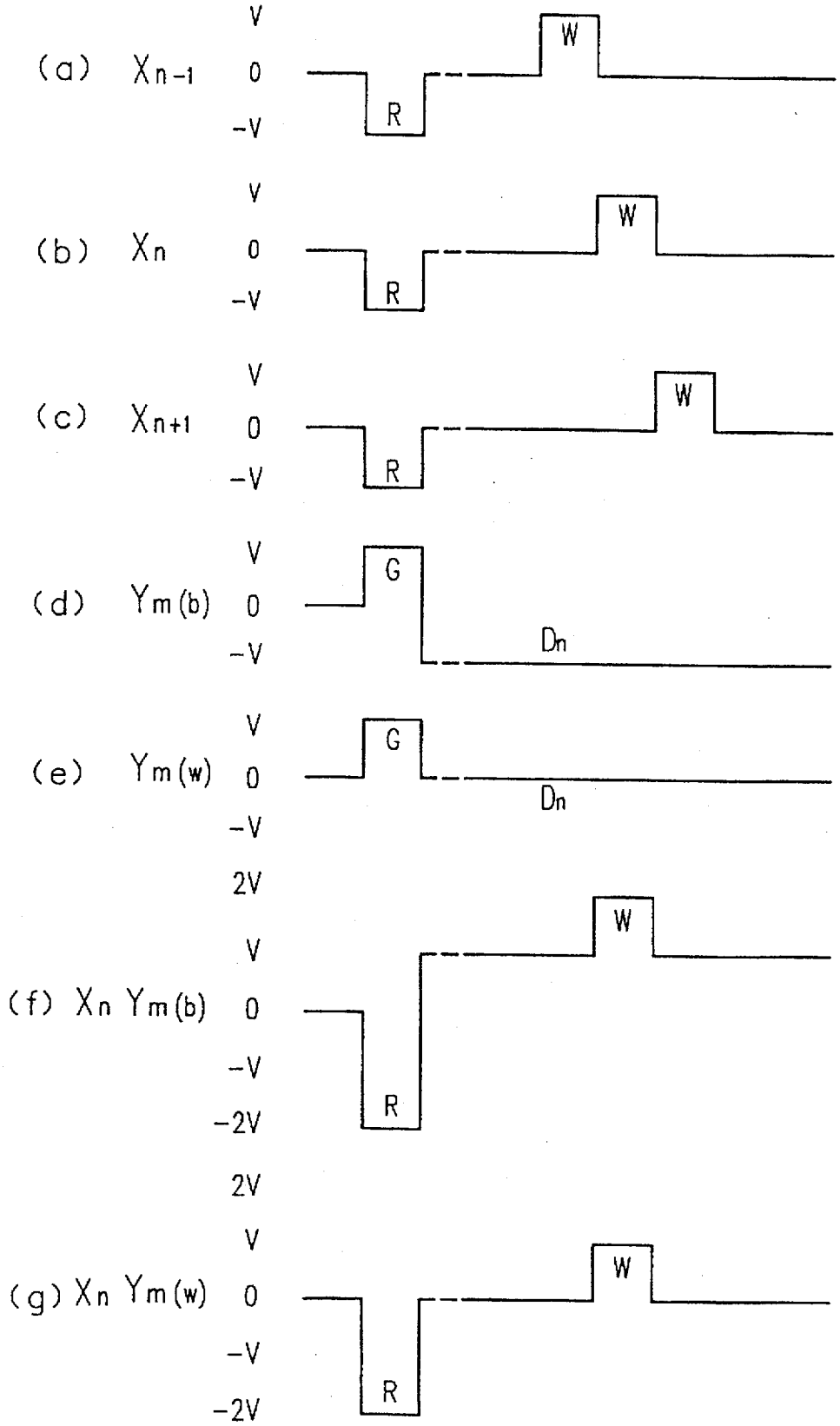
FIG. 9 is a waveform diagram illustrating signal waveforms at various elements of the active matrix substrate obtained by a conventional driving method.

As is appreciated from waveforms 3(*l*) through 3(*o*), the signal applied to a certain pixel electrode during the non-selection period of the scanning electrode line connected to the pixel electrode has the same polarity as that of the data writing pulse W applied to the pixel electrode during the selection period immediately preceding the non-selection period or has a level of 0 V. As a result, the reduction in the potential of the ferroelectric layer occurring during the non-selection period of the scanning electrode line decreases. Again with reference to FIG. 8, an example of such reduction according to the driving method in the first example will be described. Assuming the potential of the ferroelectric layer reaches point A during the selection period of the scanning electrode line, the potential of the ferroelectric layer reaches a point between point A and B during the non-selection period immediately following the selection period. Accordingly, the memory function of the ferroelectric layer can be maintained sufficiently well.

Since the maximum level of the scanning signal is set to have an identical absolute value with that of the maximum level of the data signal as is described above, the pixel electrode is supplied with a voltage of ±2 V while being in the ON state and is supplied with a voltage of ±V while being in the OFF state. As a result, a sufficient difference in the voltage can be obtained between the pixels in the ON state and the pixels in the OFF state.

Regardless of the state of the pixel, the pixel electrode is supplied with a reset pulse R having an opposite polarity to that of the data writing pulse W immediately before being supplied with the data writing pulse W. Moreover, the level of the reset pulse R applied to the pixel electrode is constant regardless of the state of the pixel. For these reasons, the time period required from reset until data writing can be substantially the same wherever the pixel is on the display plane. As a result, the uniformity in the image contrast is improved.

These effects mentioned above contribute to enhancement of the display quality.

In an LCD panel including a ferroelectric layer, the above-described voltages are divided in correspondence with the capacitance of the nonlinear device and the capacitance of the liquid crystal layer. Where the capacitance of the nonlinear device is $C_F$, the capacitance of the liquid crystal layer is $C_{LC}$, the counter electric field of the nonlinear device is $E_C$, and the thickness of the nonlinear device is d, the voltage V is expressed by the following formula.

$$|((C_{LC}/(C_{LC}+C_F))\cdot V|<E_C\cdot d<|((C_{LC}/(C_{LC}+C_F))\cdot 2V|$$

EXAMPLE 2

Figure 4:
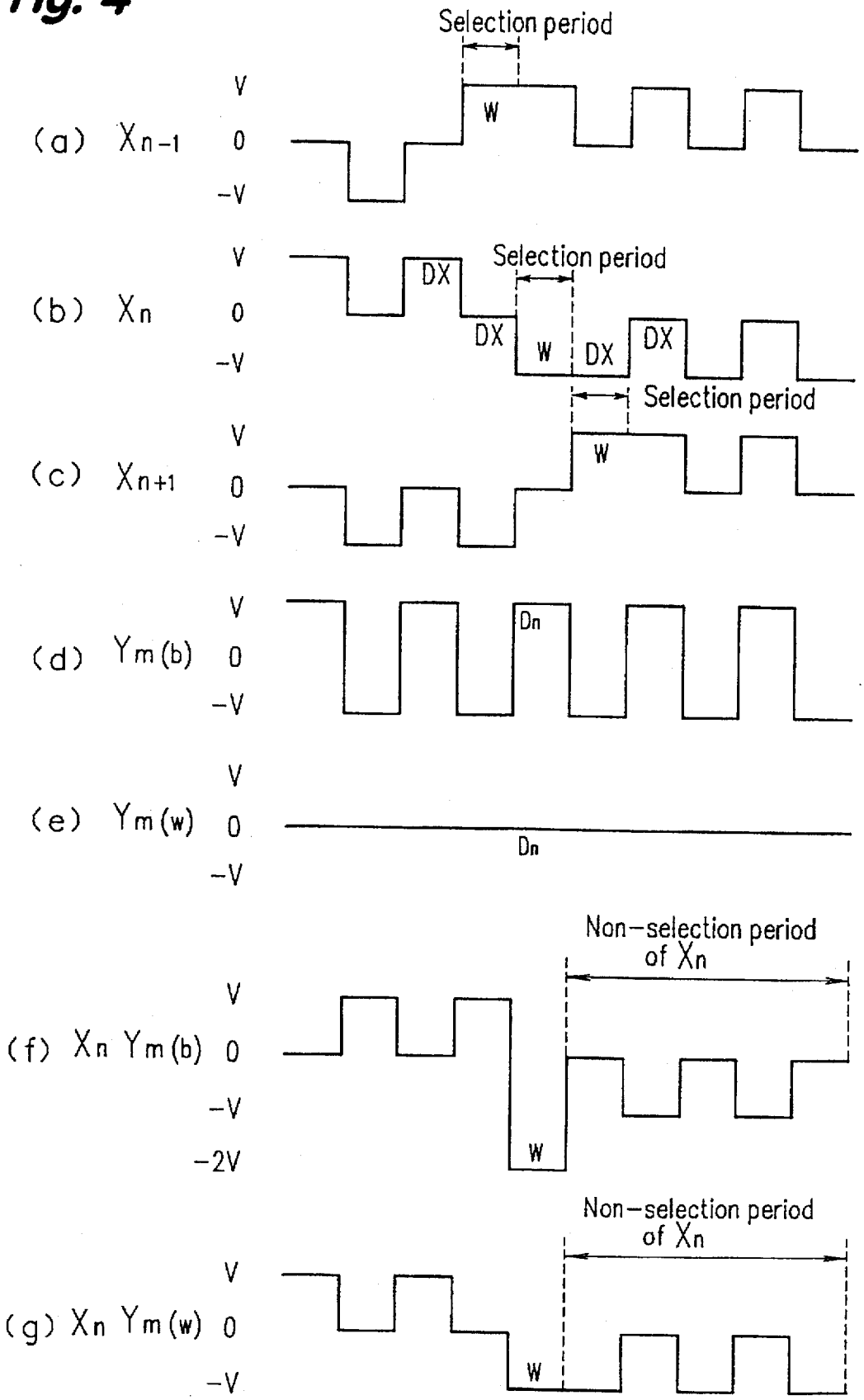
FIG. 4 is a waveform diagram illustrating signal waveforms at various elements of the active matrix substrate obtained by a driving method in a second example according to the present invention.

With reference to FIG. 4, a method for driving an active matrix substrate in a second example according to the present invention will be described. In the second example, the reset pulse R or reset compensation pulse RX is not used. For example, in the case that there is no need for consideration of an image remaining on the display plane even if binary display or display in tones are used, it is not necessary to apply a reset pulse R to the pixel electrode.

FIG. 4 shows signal waveforms obtained at various elements of the active matrix substrate by the driving method in accordance with the second example. Waveforms 4(*a*) through 4(*g*) respectively correspond to waveforms 2(*a*) through 2(*g*) in the first example.

In this example, the polarity of the data writing pulse W applied to the scanning electrode line $X_n$ in the selection period of the scanning electrode line $X_n$ is set to be negative. In such a case, as is shown in waveform 4(*b*), a data writing pulse W having a level of −V is applied to the scanning electrode line $X_n$ in the selection period thereof.

The polarity of the pulse applied to the scanning electrode line $X_{n-2}$ in the selection period of the scanning electrode line $X_{n-2}$ (not shown) is identical with the polarity of the pulse applied to the scanning electrode line $X_n$ in the selection period of the scanning electrode line $X_n$. The scanning electrode line $X_{n-2}$ is a scanning electrode line preceding the scanning electrode line $X_n$ by an even number. In the selection period of the scanning electrode line $X_{n-2}$, a data writing pulse W having a level of −V is applied to the scanning electrode line $X_{n-2}$. In synchronization with the application of the data writing pulse W, a data writing prohibiting pulse DX having a level of +V is applied to the scanning electrode line $X_n$ (waveform 4(*b*)).

As is appreciated from waveforms 4(*a*) and 4(*b*), the polarity of the pulse applied to the scanning electrode line $X_{n-1}$ in the selection period of the scanning electrode line $X_{n-1}$ is opposite to the polarity of the pulse applied to the scanning electrode line $X_n$ in the selection period of the scanning electrode line $X_n$. The scanning electrode line $X_{n-1}$ is a scanning electrode line preceding the scanning electrode line $X_n$ by an odd number. In the selection period of the scanning electrode line $X_{n-1}$, a data writing pulse W having a level of +V is applied to the scanning electrode line $X_{n-1}$. In synchronization with the application of the data writing pulse W, a data writing prohibiting pulse DX having a level of 0 V is applied to the scanning electrode line $X_n$ (waveform 4(*b*)).

As is appreciated from waveforms 4(*b*) and 4(*c*), the polarity of the pulse applied to the scanning electrode line $X_{n+1}$ in the selection period of the scanning electrode line $X_{n+1}$ is opposite to the polarity of the pulse applied to the scanning electrode line $X_n$ in the selection period of the scanning electrode line $X_n$. The scanning electrode line $X_{n+1}$ is a scanning electrode line following the scanning electrode line $X_n$ by an odd number. In the selection period of the scanning electrode line $X_{n+1}$, a data writing pulse W having a level of +V is applied to the scanning electrode line $X_{n+1}$. In synchronization with the application of the data writing pulse W, a data writing prohibiting pulse DX having a level of −V is applied to the scanning electrode line $X_n$ (waveform 4(*b*)).

The polarity of the pulse applied to the scanning electrode line $X_{n+2}$ (not shown) in the selection period of the scanning electrode line $X_{n+2}$ is identical with the polarity of the pulse applied to the scanning electrode line $X_n$ in the selection period of the scanning electrode line $X_n$. The scanning electrode line $X_{n+2}$ is a scanning electrode line following the scanning electrode line $X_n$ by an even number. In the selection period of the scanning electrode line $X_{n+2}$, a data writing pulse W having a level of −V is applied to the scanning electrode line $X_{n+2}$. In synchronization with the application of the data writing pulse W, a data writing prohibiting pulse DX having a level of 0 V is applied to the scanning electrode line $X_n$ (waveform 4(*b*)).

In order to turn ON the pixel, as is illustrated in waveform 4(*d*), a data signal having levels of −V and +V repeated alternately is applied to the data electrode line $Y_m$. In more detail, in the selection period of each scanning electrode line, in synchronization with the application of the data writing pulse W to the selected scanning electrode line, a data pulse $D_n$ having an opposite polarity to the polarity of the data writing pulse W is applied to the data electrode line $Y_m$.

In order to turn OFF the pixel, as is illustrated in waveform 4(*e*), a data signal having a level of 0 V is applied to the data electrode line $Y_m$.

The pixel electrode is supplied with a voltage having a level obtained by subtracting the level of the data signal from the level of the scanning signal. In order to turn ON the pixel connected to the scanning electrode line $X_n$ and the data electrode line $Y_m$, pulses are applied as is illustrated in waveform 4(*f*). First, in the selection period of the scanning electrode line $X_n$, a data writing pulse W having a level of −2 V is applied to the pixel electrode. Next, in a non-selection period of the scanning electrode line $X_n$, pulses having levels of −V and 0 V are applied to the pixel electrode.

In order to turn OFF the pixel connected to the scanning electrode $X_n$ and the data electrode $Y_m$, pulses are applied as is illustrated in waveform 4(*g*). First, in the selection period of the scanning electrode line $X_n$, a data writing pulse W having a level of −V is applied to the pixel electrode. Then, in a non-selection period of the scanning electrode line $X_n$, pulses having levels of −V and 0 V are applied to the pixel electrode.

By applying voltages to the pixel electrode in the above-described manner, the signal applied to the pixel electrode during the non-selection period of the scanning electrode line connected to the pixel electrode can obtain the same polarity as that of the data writing pulse W applied to the pixel electrode during the selection period immediately preceding the non-selection period or obtain a level of 0 V. Specifically, the polarity of a voltage obtained by averaging voltages applied to the pixel electrode during the non-selection period is not opposite to the polarity of the data writing pulse W during the selection period just before the non-selection period.

Figure 5:
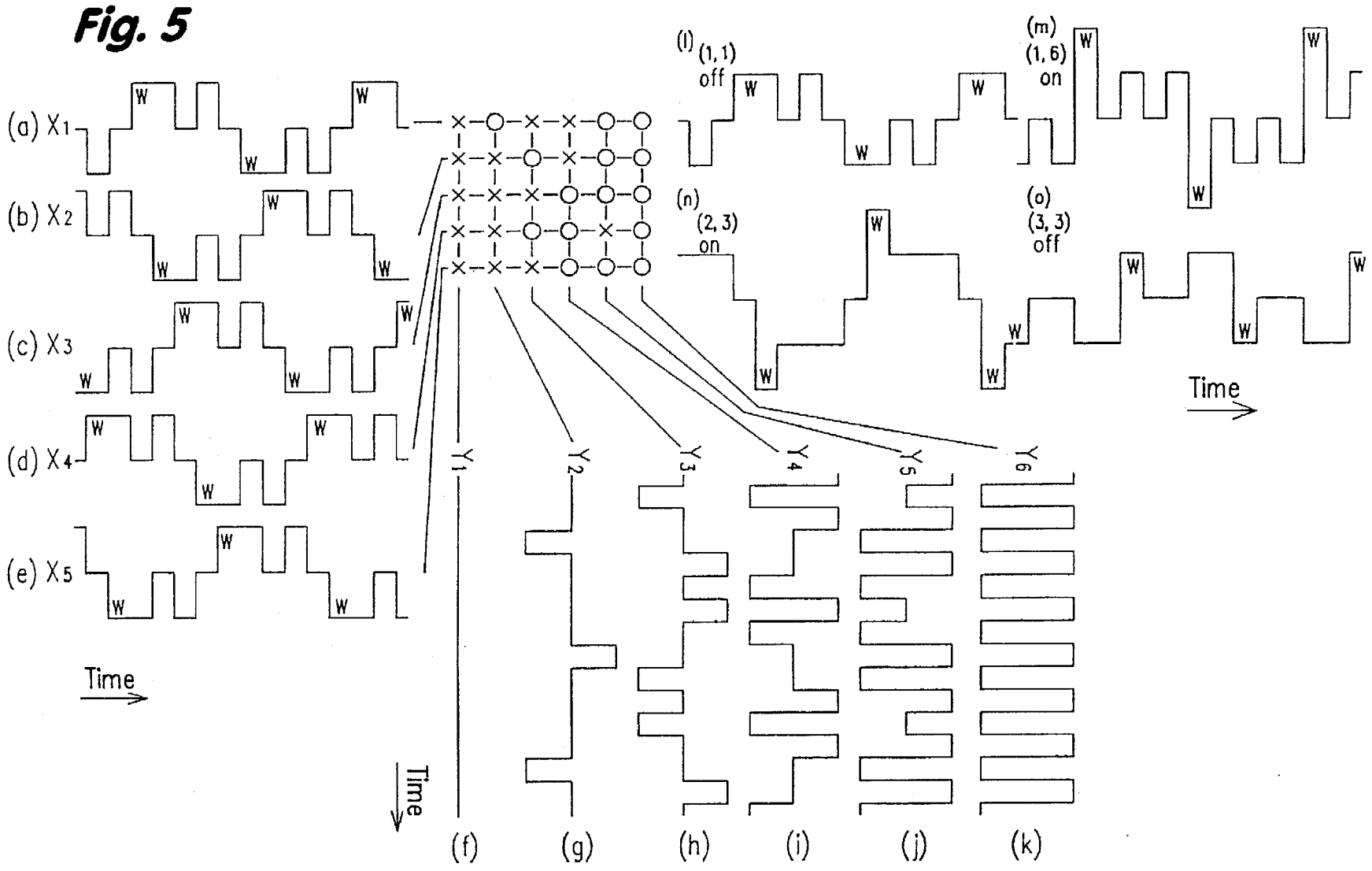
FIG. 5 is a diagram illustrating the display state of a 5×6 dot matrix LCD device driven by the method in accordance with the second example and signal waveforms obtained at various elements of an active matrix substrate used in the LCD device.

FIG. 5 is a diagram illustrating the display state of a 5×6 dot matrix LCD device driven by the method in the second example and signal waveforms obtained at various elements of an active matrix substrate in the LCD device. In Figure M, the symbol ○ indicates the pixel which is in the ON state, and the symbol x indicates the pixel which is in the OFF state. Waveforms 5(*a*) through 5(*o*) respectively correspond to waveforms 3(*a*) through 3(*o*) in the first example. In the example shown in FIG. 5, the maximum level of the scanning signal has the same absolute value as that of the maximum level of the data signal.

As is appreciated from waveforms 5(*l*) through 5(*o*), the signal applied to a certain pixel electrode during the non-selection period of the scanning electrode line connected to the pixel electrode has the same polarity as that of the data writing pulse W applied to the pixel electrode during the selection period immediately preceding the non-selection period or has a level of 0 V. Accordingly, the memory function of the ferroelectric layer can be maintained sufficiently well.

Since the maximum level of the scanning signal is set to have an identical absolute value with that of the maximum level of the data signal as is described above, a sufficient difference in the voltage can be obtained between the pixels in the ON state and the pixels in the OFF state.

These effects mentioned above contribute to enhancement of the display quality.

Further in the second example, in the case where the active matrix substrate is driven at the same frequency as in the first example, the data writing period can be twice as long as that in the first example.

EXAMPLE 3

In the first and the second examples, the polarity of the scanning signal applied to the scanning electrode lines is inverted alternately line by line (referred to as the "1H inversion system"). The present invention is not limited to such a system. In the case where the scanning electrode lines are divided into blocks each including a plurality (for example, 20 to 30) of scanning electrode lines and the polarity of scanning signal is inverted alternately block by block, the same effects can be obtained. For example, in the case that each block includes 13 scanning electrode lines, the first through the 13th scanning electrode lines are each supplied with a positive signal, and the 14th through the 26th scanning electrode lines are each supplied with a negative signal. The 27th through the 39th scanning electrode lines are each supplied with a positive signal.

In such a driving system, the total number of scanning electrode lines is possibly indivisible by the number of the scanning electrode lines included in each block without a remainder. In such a case, it is preferable that the first one or more scanning electrode lines in a certain frame in a number which is equal to the remainder in the previous frame should be supplied with a signal having an identical polarity with, or an opposite polarity to, that of the scanning electrode lines included in the remainder in the previous frame. In such a case, the scanning electrode lines from the next one in the certain frame are divided into blocks for block-by-block polarity inversion of the pulse to be applied. In this manner, the uniformity in the image contrast is improved compared with the case where the total number of scanning electrode lines is divisible by the number of scanning electrode lines included in each block. Accordingly, it is preferable that the number of scanning electrode lines included in each block should not be a divisor of the total number of scanning electrode lines.

Hereinafter, with reference to FIG. 6, a method for driving an active matrix substrate in a third example according to the present invention will be described. In the third example, the 2H inversion system, in which the polarity of data signal is inverted alternately every two data signals, is used. In accordance therewith, the polarity of the scanning signals is also inverted block by block, each block including two scanning electrode lines.

Figure 6:
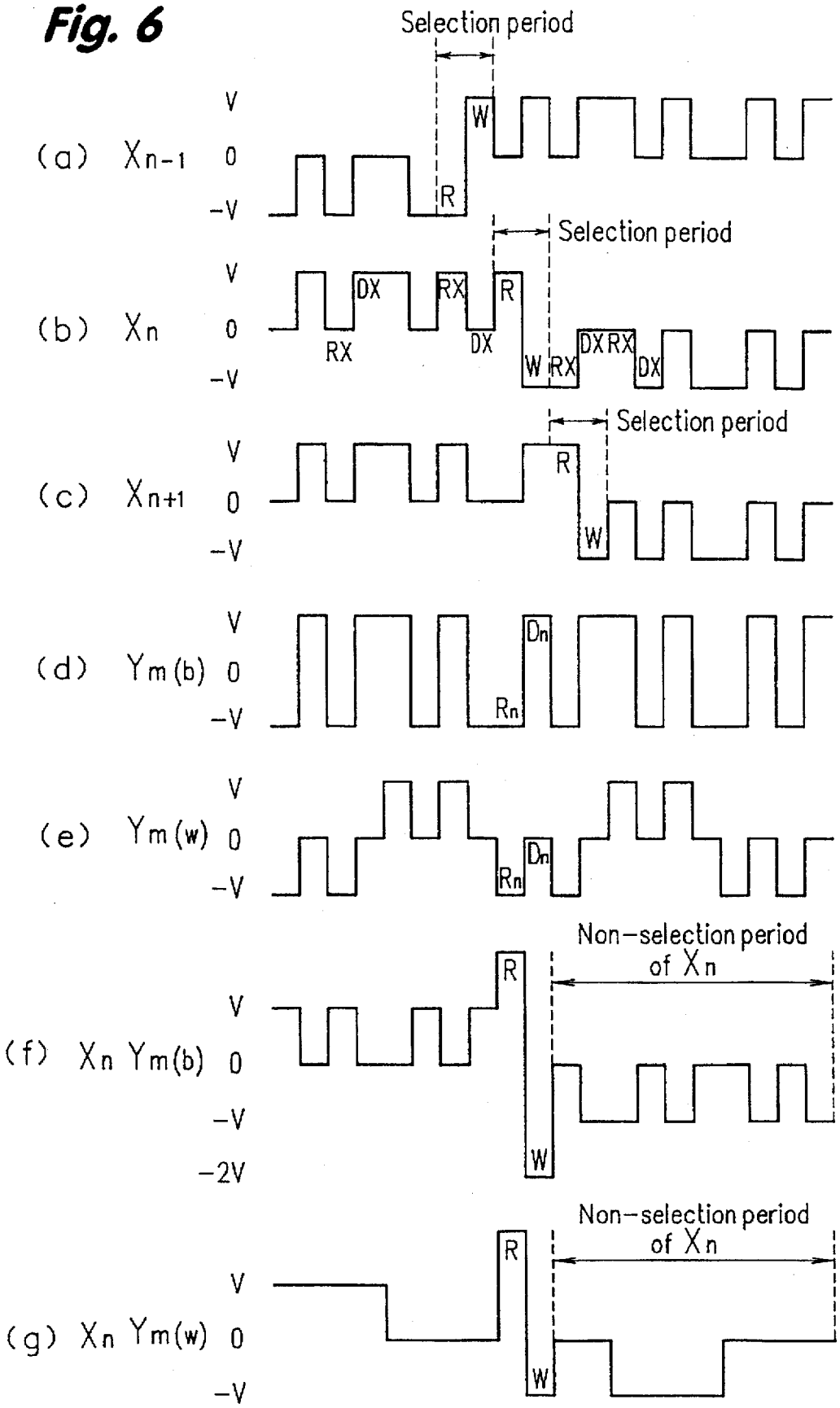
FIG. 6 is a waveform diagram illustrating signal waveforms at various elements of the active matrix substrate obtained by a driving method in a third example according to the present invention.

FIG. 6 shows signal waveforms obtained at various elements of the active matrix substrate by the driving method in accordance with the third example. Waveforms 6(*a*) through 6(*g*) correspond to waveforms 2(*a*) through 2(*g*) in the first example, respectively.

In this example, the polarity of the data writing pulse W applied to the scanning electrode line $X_n$ in the selection period of the scanning electrode line $X_n$ is set to be negative. In such a case, as is shown in FIG. 6(*b*), a reset pulse R having a level of +V and a data writing pulse W having a level of −V are applied to the scanning electrode line $X_n$ in the selection period thereof.

The scanning electrode line $X_{n-j}$ is a representative of a scanning electrode line which precedes the scanning electrode lane $X_n$ and has an identical polarity with that of the scanning electrode line $X_n$. In the selection period of the scanning electrode line $X_{n-j}$, a reset pulse R and a data writing pulse W are applied to the scanning electrode line $X_{n-j}$. In synchronization with the application of the reset pulse R and the data writing pulse W, a reset compensation pulse RX having a level of 0 V and a data writing prohibiting pulse DX having a level of +V are applied to the scanning electrode line $X_n$ (waveform 6(*b*)).

The scanning electrode line $X_{n-k}$ is a representative of a scanning electrode line which precedes the scanning electrode line $X_n$ and has an opposite polarity to that of the scanning electrode line $X_n$. For example, the scanning electrode line $X_{n-1}$ belongs to the scanning electrode line $X_{n-k}$. In the selection period of the scanning electrode line $X_{n-k}$, a reset pulse R and a data writing pulse W are applied to the scanning electrode line $X_{n-k}$. In synchronization with the application of the reset pulse R and the data writing pulse W, a reset compensation pulse RX having a level of +V and a data writing prohibiting pulse DX having a level of 0 V are applied to the scanning electrode line $X_n$ (waveform 6(*b*)).

The scanning electrode line $X_{n+j}$ is a representative of a scanning electrode line which follows the scanning electrode line $X_n$ and has an identical polarity of that of the scanning electrode line $X_n$. For example, the scanning electrode line $X_{n+1}$ belongs to the scanning electrode line $X_{n+j}$. In the selection period of the scanning electrode line $X_{n+j}$, a reset pulse R and a data writing pulse W are applied to the scanning electrode line $X_{n+j}$. In synchronization with the application of the reset pulse R and the data writing pulse W, a reset compensation pulse RX having a level of −V and a data writing prohibiting pulse DX having a level of 0 V are applied to the scanning electrode line $X_n$ (waveform 6(*b*)).

The scanning electrode line $X_{n+k}$ is a representative of a scanning electrode line which follows the scanning electrode line $X_n$ and has an opposite polarity to that of the scanning electrode line $X_n$. In the selection period of the scanning electrode line $X_{n+k}$, a reset pulse R and a data writing pulse W are applied to the scanning electrode line $X_{n+k}$. In synchronization with the application of the reset pulse R and the data writing pulse W, a reset compensation pulse RX having a level of 0 V and a data writing prohibiting pulse DX having a level of −V are applied to the scanning electrode line $X_n$ (waveform 6(*b*)).

In order to turn ON the pixel, as is illustrated in waveform 6(*d*), a data signal having levels of −V and +V repeated alternately is applied to the data electrode line $Y_m$. In more detail, in the selection period of each scanning electrode line, in synchronization with the application of the reset pulse R and a data writing pulse W to the selected scanning electrode line, a reset pulse $R_n$ having an opposite polarity to the polarity of the reset pulse R and a data pulse $D_n$ having an opposite polarity to the polarity of the data pulse D are applied to the data electrode line $Y_m$.

In order to turn OFF the pixel, as is illustrated in waveform 6(*e*), a data signal having levels of −V, 0 V and +V repeated alternately is applied to the data electrode line $Y_m$. In more detail, in the selection period of each scanning electrode line, in synchronization with the application of the reset pulse R and a data writing pulse W to the selected scanning electrode line, a reset pulse $R_n$ having an opposite polarity to the polarity of the reset pulse R and a data pulse $D_n$ having a level of 0 V are applied to the data electrode line $Y_m$.

The pixel electrode is supplied with a voltage having a level obtained by subtracting the level of the data signal from the level of the scanning signal. In order to turn ON the pixel connected to the scanning electrode $X_n$ and the data electrode $Y_m$, pulses are applied as is illustrated in waveform 6(*f*). First, in the selection period of the scanning electrode line $X_n$, a data writing pulse W having a level of −2 V is applied to the pixel electrode. Next, in a non-selection period of the scanning electrode line $X_n$, pulses having levels of −V and 0 V are applied to the pixel electrode.

In order to turn OFF the pixel connected to the scanning electrode $X_n$ and the data electrode $Y_m$, pulses are applied as is illustrated in waveform 6(*g*). First, in the selection period of the scanning electrode line $X_n$, a data writing pulse W having a level of –V is applied to the pixel electrode. Then, in a non-selection period of the scanning electrode line $X_n$, pulses having levels of –V and 0 V are applied to the pixel electrode.

By applying voltages to the pixel electrode in the above-described manner, the signal applied to the pixel electrode during the non-selection period of the scanning electrode line connected to the pixel electrode can obtain the same polarity as that of the data writing pulse W applied to the pixel electrode during the selection period immediately preceding the non-selection period or obtain a level of 0 V. Specifically, the polarity of a voltage obtained by averaging voltages applied to the pixel electrode during the non-selection period is not opposite to the polarity of the data writing pulse W during the selection period just before the non-selection period.

Since the scanning signal is applied to the scanning electrode lines while the polarity thereof is inverted alternately block by block each including a plurality of scanning electrode lines, the non-uniformity of image contrast which is caused by the phenomenon that different pixel electrodes receive different voltages during the non-selection period because of different pulses applied thereto during the selection period can be substantially solved.

Figure 7:
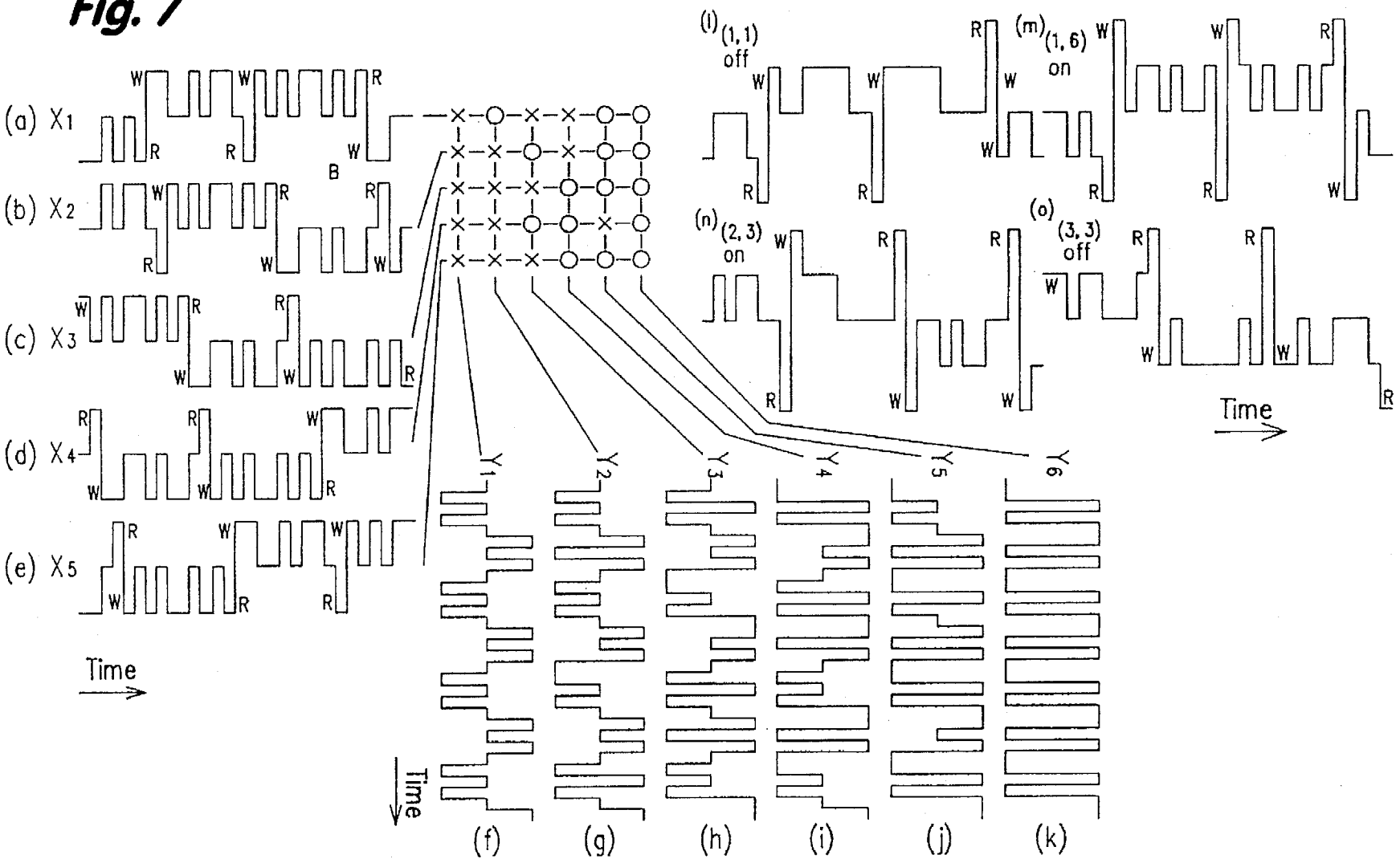
FIG. 7 is a diagram illustrating the display state of a 5×6 dot matrix LCD device driven by the method in accordance with the third example and signal waveforms obtained at various elements of an active matrix substrate used in the LCD device.

FIG. 7 is a diagram illustrating the display state of a 5×6 dot matrix LCD device driven by the method in the third example and signal waveforms obtained at of various elements of an active matrix substrate in the LCD device. In FIG. 7, the symbol ○ indicates the pixel which is in the ON state, and the symbol x indicates the pixel which is in the OFF state. Waveforms 7(*a*) through 7(*o*) respectively correspond to waveforms 3(*a*) through 3(*o*) in the first example. In the example shown in FIG. 7, the maximum level of the scanning signal has the same absolute value as that of the maximum level of the data signal.

As is appreciated from waveforms 7(*l*) through 7(*o*), the signal applied to the pixel electrode during the non-selection period of the scanning electrode line connected to the certain pixel electrode has the same polarity as that of the data writing pulse W applied to the pixel electrode during the selection period immediately preceding the non-selection period or has a level of 0 V. Accordingly, the memory function of the ferroelectric layer can be maintained sufficiently well.

Since the maximum level of the scanning signal is set to have an identical absolute value with that of the maximum level of the data signal as is described above, a sufficient difference in the voltage can be obtained between the pixels in the ON state and the pixels in the OFF state.

Regardless of the state of the pixel, the pixel electrode is supplied with a reset pulse R having an opposite polarity to that of the data writing pulse W immediately before being supplied with the data writing pulse W, and moreover, the level of the reset pulse R applied to the pixel electrode is constant regardless of the state of the pixel. For these reasons, the time period required from reset until data writing can be substantially the same wherever the pixel is on the display plane. As a result, the uniformity in the image contrast is improved. However, the reset pulse can be omitted in a case where it is not necessary to reset, as described in the second example.

These effects mentioned above contribute to enhancement of the display quality.

In this example, each block includes two scanning electrode lines, and the total number of the scanning electrode lines is five. Since two is not a divisor of five, the first scanning electrode line in a certain frame is supplied with a pulse having an identical polarity with that of the last scanning electrode line in the previous frame. In this manner, the uniformity in the image contrast is further improved for additional enhancement in the display quality.

Table 1 indicates the polarity of each signal applied to the scanning electrode $X_n$ in the selection and the non-selection periods thereof in the case that a negative data writing pulse W is applied to the scanning electrode $X_n$ in the selection period thereof.

In the first and second examples, "selection period (–)" corresponds to the selection period of the scanning electrode line $X_n$, "before selection period (–)" corresponds to the selection period of the scanning electrode line $X_{n-2}$, "before selection period (+)" corresponds to the selection period of the scanning electrode line $X_{n-1}$, "after selection period (+)" corresponds to the selection period of the scanning electrode line $X_{n+1}$, and "after selection period (–)" corresponds to the selection period of the scanning electrode line $X_{n+2}$.

In the third example, "selection period (–)" corresponds to the selection period of the scanning electrode line $X_n$, "before selection period (–)" corresponds to the selection period of the scanning electrode line $X_{n-j}$, "before selection period (+)" corresponds to the selection period of the scanning electrode line $X_{n-k}$, "after selection period (+)" corresponds to the selection period of the scanning electrode line $X_{n+k}$, and "after selection period (–)" corresponds to the selection period of the scanning electrode line $X_{n+j}$.

TABLE 1

| Period | | Before selection period | | | | Selection period | | After selection period | | | |
|---|---|---|---|---|---|---|---|---|---|---|---|
| Polarity | | – | | + | | – | | + | | – | |
| Pulse | | Reset | Data | Reset | Data | Reset | Data | Reset | Data | Reset | Data |
| Signal electrode line | | 0 | +V | +V | 0 | +V | –V | 0 | –V | –V | 0 |
| Data electrode | on | –V | +V | +V | –V | –V | +V | +V | –V | –V | +V |
| line | off | –V | 0 | +V | 0 | –V | 0 | +V | 0 | –V | 0 |
| Pixel electrode | on | +V | 0 | 0 | +V | +2V | –2V | –V | 0 | 0 | –V |
| | off | +V | +V | 0 | 0 | +2V | –V | –V | –V | 0 | 0 |

In the case where a positive data writing pulse W is applied to the scanning electrode $X_n$ in the selection period thereof, the signals having the opposite polarities to those mentioned in Table 1 are applied. In the system of applying signal to the scanning electrode lines while inverting the polarity thereof block by block each including a plurality of scanning electrode lines, if the two adjacent scanning electrode lines are respectively supplied with data writing pulses having the same polarity, the polarity of the pulse applied to the second scanning electrode line immediately before the selection period thereof is opposite to the polarity of the pulse applied to the first scanning electrode line immediately before the selection period thereof.

A TN LCD device including 480 scanning lines and a nonlinear device formed of a ferroelectric layer was actually driven by a method according to the present invention. No malfunction was caused by the deterioration in the memory function of the ferroelectric layer. A high image contrast ratio of 100:1 or more was obtained as well as high uniformity in the image contrast in the entire display plane. The signal electrode was formed of aluminum, and the ferroelectric layer was formed of a copolymer of poly(vinylidene cyanide) and vinyl acetate.

In the above description, the scanning electrode lines and the data electrode lines are supplied with the same level of voltages. However, the voltages applied to the scanning electrode lines and the data electrode lines may be different from each other. Other parameters such as the distribution of the voltages to the scanning electrode lines and the data electrode lines, the bias voltages applied to the electrodes in each of the frames, and the voltage ratio between the scanning signal and the data signal may be arbitrarily determined within the scope of the present invention. The voltages applied to the pixels described above are measured on the side of the scanning electrode lines.

The present invention is applicable to active matrix substrates having different structures from the structure shown in FIG. 1. For example, the present invention is applicable to an active matrix substrate described in Japanese Laid-Open Patent Publication No. 2-2512. Further, the present invention is applicable to an active matrix substrate for use in super twisted nematic, electrically controlled birefringence, dynamic scattering, polymer scattering, polymer matrix and guest-host LCD devices, LCD devices using a ferroelectric liquid crystal material or an anti-ferroelectric liquid crystal material, display devices using electroluminescence or electrochromic phenomenon, and data processing apparatuses using such technologies.

According to the present invention, as has been described so far, the memory function of the nonlinear device formed of a ferroelectric material is maintained sufficiently well, and thus malfunction can be prevented from occurring by the deterioration of the memory function.

By applying the scanning signal to the scanning electrode lines while inverting the polarity thereof line by line or block by block, the uniformity of the image contrast is improved. In the case where the number of scanning electrode lines included in each block is not a divisor of the total number of scanning electrode lines, the first one or more scanning electrode lines in a certain frame in a number which is equal to the remainder in the previous frame is supplied with a signal having an identical polarity with or an opposite polarity to that of the scanning electrode lines included in the remainder in the previous frame, and the scanning electrode lines from the next one in the certain frame are divided into blocks for block-by-block polarity inversion of the pulse to be applied.

By performing reset immediately before data writing, the time period required from reset until data writing can be substantially the same in the entire display plane. As a result, the uniformity in the image contrast is improved.

For these effects, the display quality is greatly raised in a display device such as an LCD device.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving an active matrix substrate including a plurality of scanning electrode lines, a plurality of data electrode lines, and a plurality of pixel electrodes respectively connected to the scanning electrode lines and the data electrode lines via a ferroelectric material, the method comprising the steps of:

applying a data writing pulse having a first polarity to a scanning electrode line selected from the plurality of scanning electrode lines in a selection period;

applying a data writing prohibiting pulse having a level of 0 to the selected scanning electrode line in a first period included in a non-selection period following the selection period, a data writing pulse having the first polarity being applied to a scanning electrode line different from the selected scanning electrode line during the first period;

applying a data writing prohibiting pulse having the first polarity to the selected scanning electrode line in a second period included in the non-selection period, a data writing pulse having a second polarity being applied to a scanning electrode line different from the selected scanning electrode line during the second period;

applying a data pulse having the second polarity or a level of 0 to the respective plurality of data electrode lines in the first period; and applying a data pulse having the first polarity or a level of 0 to the respective plurality of the data electrode lines in the second period, wherein a voltage applied to the selected scanning electrode line in the non-selection period has a same polarity as that of the data writing pulse applied to the selected scanning electrode line in the selection period immediately before the non-selection period or a level of 0.

2. A method for driving an active matrix substrate according to claim 1, further comprising the steps of:

applying a reset pulse having the second polarity to the selected scanning electrode line in the selection period immediately before applying the data writing pulse having the first polarity to the selected scanning electrode line;

applying a reset compensation pulse having the first polarity to the selected scanning electrode line in the first period immediately before applying the data writing prohibiting pulse having a level of 0 to the selected scanning electrode line; and applying a reset compensation pulse having a level of 0 to the selected scanning electrode line in the second period immediately before applying the data writing prohibiting pulse having the first polarity to the selected scanning electrode line.

3. A method for driving an active matrix substrate according to claim 1, further comprising the step of repeating the first period and the second period alternately each time one of the plurality of scanning electrode lines is selected.

4. A method for driving an active matrix substrate according to claim 1, wherein the plurality of scanning electrode lines are divided into blocks each including a plurality of scanning electrode lines, the method further comprising the step of repeating the first period and the second period alternately each time one of the blocks is selected.

5. A method for driving an active matrix substrate according to claim 4, wherein the total number of the scanning electrode lines is indivisible by the number of the scanning electrode lines included in each of the blocks without a remainder.

6. A method for driving an active matrix substrate according to claim 5, further comprising the step of inverting the polarity of the plurality of scanning electrode lines block by block, starting from a scanning electrode line in a current frame which is next to at least one scanning electrode line in a number equal to the remainder in a previous frame.

7. A method for driving an active matrix substrate including a plurality of scanning electrode lines, a plurality of data electrode lines, and a plurality of pixel electrodes respectively connected to the scanning electrode lines and the data electrode lines via a ferroelectric material, the method comprising the steps of:

applying a data write signal to a pixel having a first voltage polarity during a pixel selection period when the pixel is selected by a scanning signal, and during a next, subsequent non-selection period when the pixel is not selected by the scanning signal, applying a follow-up signal to the pixel which varies between a signal having the same voltage polarity as the previously applied data write signal and a zero level at least until a next pixel selection period when the pixel is again selected by a scanning signal.

8. A method for driving an active matrix substrate including a plurality of scanning electrode lines, a plurality of data electrode lines, and a plurality of pixel electrodes respectively connected to the scanning electrode lines and the data electrode lines via a ferroelectric material, the method comprising the steps of:

applying a data write signal to a pixel during a pixel selection period, and just after the pixel selection period, applying a signal to the pixel during a pixel non-selection period, the signal varying between a signal whose voltage polarity is the same as a voltage polarity of the data write signal and a zero level at least until a next pixel selection period when the pixel is again selected by a scanning signal.

* * * * *